US005862858A

United States Patent [19]

Wellington et al.

[11] Patent Number: 5,862,858

[45] Date of Patent: Jan. 26, 1999

[54] FLAMELESS COMBUSTOR

[75] Inventors: Scott Lee Wellington; Thomas Mikus; Harold J. Vinegar; John Michael Karanikas, all of Houston, Tex.

[73] Assignee: Shell Oil Company, Houston, Tex.

[21] Appl. No.: 774,163

[22] Filed: Dec. 26, 1996

[51] Int. Cl.[6] ..... E21B 43/24

[52] U.S. Cl. ..... 166/59; 431/2

[58] Field of Search ..... 166/57, 59, 61; 431/2, 7, 157, 208, 215, 350, 170, 353, 268

[56] References Cited

U.S. PATENT DOCUMENTS

| | | | |
|---|---|---|---|
| 3,113,623 | 12/1963 | Krueger | 166/59 |
| 3,180,748 | 4/1965 | Holmgren et al. | 106/104 |
| 3,181,613 | 5/1965 | Krueger | 166/38 |
| 3,507,332 | 4/1970 | Venable et al. | 166/292 |
| 3,817,332 | 6/1974 | Berry et al. | 166/302 |
| 3,916,869 | 11/1975 | Dufour | 126/92 C |
| 3,928,961 | 12/1975 | Pfefferle | 60/39.02 |
| 4,065,917 | 1/1978 | Pfefferle | 60/39.82 |
| 4,237,973 | 12/1980 | Todd | 166/59 |
| 4,377,205 | 3/1983 | Retallick | 166/59 |
| 4,445,570 | 5/1984 | Retallick | 166/59 |
| 4,640,352 | 2/1987 | Vanmeurs et al. | 166/245 |
| 4,706,751 | 11/1987 | Gondouin | 166/272 |
| 4,886,118 | 12/1989 | Van Meurs et al. | 166/245 |
| 5,255,742 | 10/1993 | Mikus | 166/303 |
| 5,326,252 | 7/1994 | Tonon | 126/91 A |
| 5,355,668 | 10/1994 | Weil et al. | 60/39.06 |
| 5,404,952 | 4/1995 | Vinegar et al. | 166/303 |

FOREIGN PATENT DOCUMENTS

| | | | |
|---|---|---|---|
| 0072675 A | 2/1983 | European Pat. Off. . | |
| 0266875 | 5/1988 | European Pat. Off. | 502/333 |

*Primary Examiner*—William Neuder
*Attorney, Agent, or Firm*—Del S. Christensen

[57] ABSTRACT

A combustor method and apparatus is provided. The method utilizes flameless combustion. The absence of a flame eliminates the flame as a radiant heat source and results in a more even temperature distribution throughout the length of the burner. Flameless combustion is accomplished by preheating the fuel and the combustion air to a temperature above the autoignition temperature of the mixture. The present invention lowers the autoignition temperature by placing a catalytic surface within the desired combustion chamber. Temperatures are maintained above the catalyzed autoignition temperature but less than the noncatalyzed autoignition temperatures for noncatalyzed reaction. Thus, the amount and location of reaction can be controlled by varying the amount and distribution of catalyst within the burner. Removing heat from the combustion chamber in amounts that correspond to the oxidation of fuel within different segments of the combustion chamber can result in low temperatures and relatively even distribution of heat from the burner.

14 Claims, 2 Drawing Sheets

FLAMELESS COMBUSTOR

FIELD OF THE INVENTION

This invention relates to a combustor apparatus and method.

BACKGROUND TO THE INVENTION

U.S. Pat. Nos. 4,640,352 and 4,886,118 disclose conductive heating of subterranean formations of low permeability that contain oil to recover oil therefrom. Low permeability formations include diatomites, lipid coals, and oil shales. Formations of low permeability are not amiable to secondary oil recovery methods such as steam, carbon dioxide, or fire flooding. Flooding materials tend to penetrate formations that have low permeabilities preferentially through fractures. The injected materials bypass most of the formation hydrocarbons. In contrast, conductive heating does not require fluid transport into the formation. Oil within the formation is therefore not bypassed as in a flooding process. When the temperature of a formation is increased by conductive heating, vertical temperature profiles will tend to be relatively uniform because formations generally have relatively uniform thermal conductivities and specific heats. Transportation of hydrocarbons in a thermal conduction process is by pressure drive, vaporization, and thermal expansion of oil and water trapped within the pores of the formation rock. Hydrocarbons migrate through small fractures created by the expansion and vaporization of the oil and water.

U.S. Pat. No. 5,255,742 discloses a flameless combustor useful for heating subterranean formations that utilizes preheated fuel gas and/or combustion air wherein the fuel gas is combined with the combustion air in increments that are sufficiently small that flames are avoided. Creation of $NO_x$ is almost eliminated, and cost of the heaters can be significantly reduced because of less expensive materials of construction. Preheating the fuel gas according to the invention of patent '742 results in coke formation unless $C0_2$, $H_2$, or steam is added to the fuel gas. Further, start-up of the heater of patent '742 is a time consuming process because it must operate at temperatures above the uncatalyzed autoignition temperature of the fuel gas mixture.

Catalytic combustors are also known. For example, U.S. Pat. No. 3,928,961 discloses a catalytically-supported thermal combustion apparatus wherein formation of $NO_x$ is eliminated by combustion at temperatures above autoignition temperatures of the fuel, but less than those temperatures at which result in substantial formation of oxides of nitrogen.

Metal surfaces coated with oxidation catalyst are disclosed in, for example, U.S. Pat. Nos. 5,355,668 and 4,065,917. These patents suggest catalytic coated surfaces on components of a gas turbine engine. Patent '917 suggests use of catalytic coated surfaces for start-up of the turbine, and suggests a mass transfer control limited phase of the start-up operation.

It is therefore an object of the present invention to provide a combustion method and apparatus which is flameless, and does not require additives in a fuel gas stream to prevent formation of coke. In another aspect of the present invention, it is an object to provide a combustion method and apparatus wherein formation of $NO_x$ is minimal. It is also an object of the present invention to provide a flameless combustor wherein fuel and oxidant can be combined initially, and distribution of combustion determined by distribution of catalytic surfaces within a combustion chamber.

SUMMARY OF THE INVENTION

These and other objects are accomplished by a flameless combustor for combustion of a fuel and oxidant mixture, the combustor comprising:

- a combustion chamber in communication with an inlet at one end and in communication with a combustion product outlet at the other end;
- a mixed fuel and oxidant supply in communication with the inlet; and
- a catalyst surface within the combustion chamber wherein the catalyst surface is effective to cause oxidization of an amount of fuel wherein the oxidation of the amount of fuel does not result in a temperature above an uncatalyzed autoignition temperature of the fuel and oxidant mixture.

The flameless combustion of the present invention results in minimal production of nitrous oxides because temperatures that would result from adiabatic combustion of the fuel-oxidant mixture are avoided. Other measures to remove or prevent the formation of nitrous oxides are therefore not required. Relatively even heat distribution over a large area and long lengths are possible, and relatively inexpensive materials of construction for the combustor of the present invention can be used because of lower combustion temperatures.

Acceptable catalyst materials include noble metals, semi-precious metals, and transition metal oxides. Generally, known oxidation catalysts are useful in the present invention. Mixtures of such metals or metal oxides could also be useful.

The flameless combustor of the present invention is particularly useful as a heat injector for heating subterranean formations for recovery of hydrocarbons. The catalytic surfaces also improve operability and start-up operations of such heat injectors. The present invention eliminates a need to transport fuels and oxidants in separate conduits to the combustion zone in such heat injectors. This results in significant cost savings.

DETAILED DESCRIPTION OF THE INVENTION

Generally, flameless combustion is accomplished by preheating combustion air and fuel gas sufficiently that when the two streams are combined the temperature of the mixture exceeds the autoignition temperature of the mixture, but to a temperature less than that which would result in the oxidation upon mixing being limited by the rate of mixing. Without a catalyst surface present, preheating of the streams to a temperature between about 1500° F. and about 2300° F. and then mixing the fuel gas into the combustion air in relatively small increments will result in flameless combustion.

With an effective catalytic surface present, the temperature at which oxidation reactions occur in a region affected by the catalytic surface is significantly lowered. This reduced temperature is referred to herein as a catalyzed autoignition temperature. In turbulent flow, fluid in a boundary layer that contacts the catalytic surface will be oxidized almost quantitatively, but almost no oxidation will occur outside of the boundary layer if the bulk temperatures remain below the non-catalyzed autoignition temperatures of the mixture. Thus, reaction in the temperature range between the catalyzed autoignition temperature and the noncatalyzed autoignition temperature is mass-transfer limited, at a rate that is relatively independent of temperature. This is suggested in references such as U.S. Pat. No. 4,065,917. This mass transfer limited reaction mechanism is utilized in the present invention to control distribution of heat generation within the combustion chamber of the flameless combustor. Heat generation and heat removal can be balanced so that the average stream temperature of the mixed oxidant, fuel, and combustion products remains between the catalyzed autoignition temperature and the noncatalyzed autoignition temperature.

The heater of the present invention can be controlled by such variables as fuel-oxidant ratio, fuel-oxidant flowrate. Depending on the particular application, the heat load may be subject to controls.

An important feature of the flameless combustor of the present invention is that heat is removed along the axis of the combustion chamber so that a temperature is maintained that is significantly below the adiabatic combustion temperature would be. This almost eliminates formation of $NO_x$s, and also significantly reduces metallurgical requirements resulting in a relatively inexpensive combustor.

Figure 1:
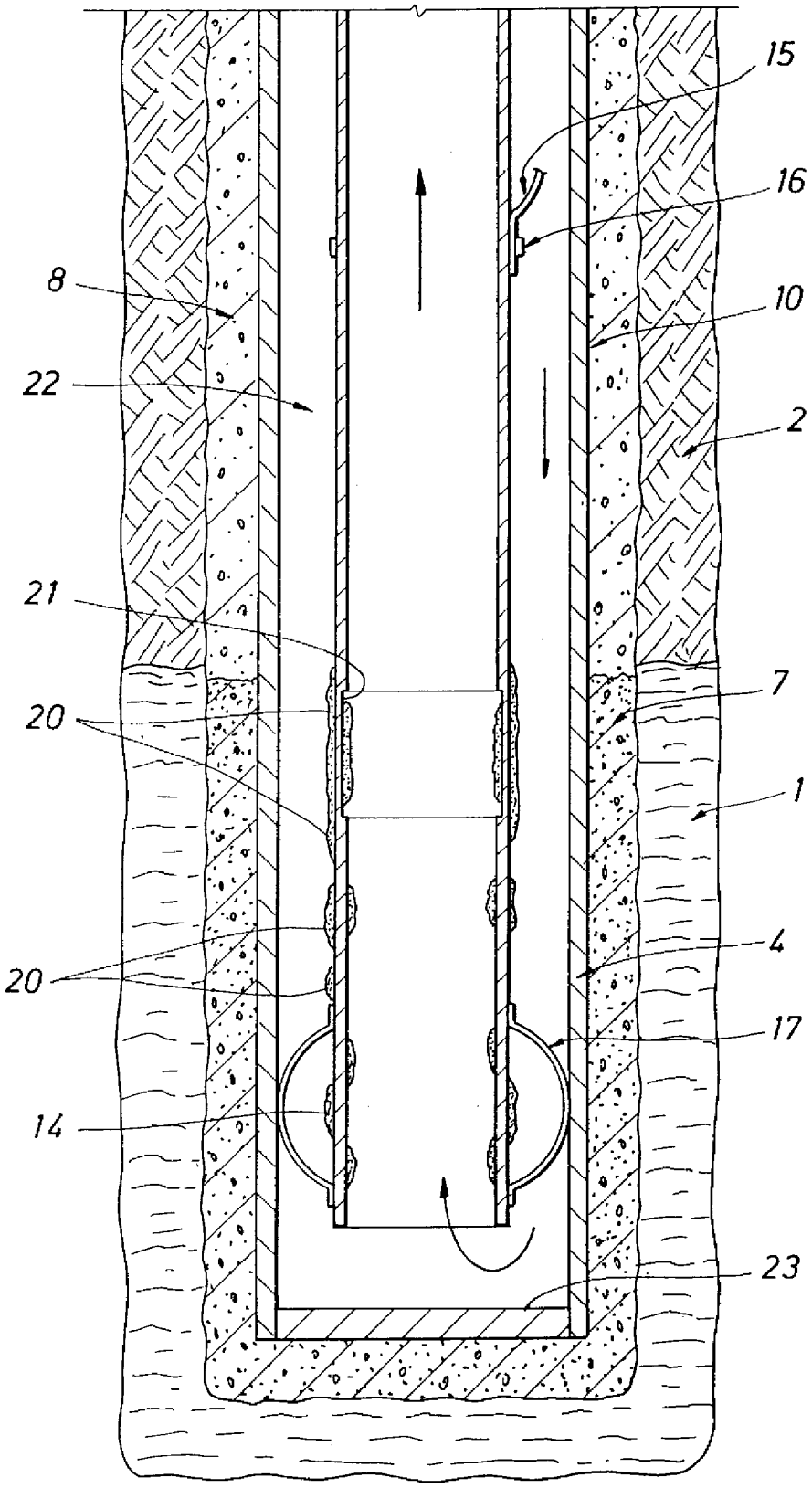
FIG. 1 shows a combustor according to the present invention.

Referring to FIG. 1, a combustor within a heat injection well capable of carrying out the present invention is shown. A formation to be heated, 1, is below an overburden, 2. A wellbore, 3, extends through the overburden and to a position that is preferably near the bottom of the formation to be heated. A vertical well is shown, but the wellbore could be deviated or horizontal. Horizontal heat injector wells may be provided in formations that fracture horizontally to recover hydrocarbons by a parallel drive process. Shallow oil shale formations are examples of formations where horizontal heaters may be useful. Horizontal heaters may also be effectively used when thin layers are to be heated to limit heat loss to overburden and base rock. In the embodiment shown in FIG. 1, the wellbore is cased with a casing, 4. The lower portion of the wellbore may be cemented with a cement, 7, having characteristics suitable for withstanding elevated temperatures and transferring heat. A cement which is a good thermal insulator, 8, is preferred for the upper portion of the wellbore to prevent heat loss from the system. A combustion mixture conduit, 10, extends from the wellhead (not shown) to the lower portion of the wellbore.

High temperature cements suitable for cementing casing and conduits within the high temperature portions of the wellbore are available. Examples are disclosed in U.S. Pat. Nos. 3,507,332 and 3,180,748. Alumina contents above about 50 percent by weight based on cements slurry solids are preferred.

In shallow formations, it may be advantageous to hammer-drill the heater directly into the formation. When the heater is hammer-drilled directly into the formation, cementing of the heater in the formation may not be required, but an upper portion of the heater may be cemented to prevent fluid loss to the surface.

Choice of a diameter of the casing, 4, in the embodiment of FIG. 1 is a trade-off between the expense of the casing, and the rate at which heat may be transferred into the formation. The casing, due to the metallurgy required, is generally the most expensive component of the injection well. The heat that can be transferred into the formation increases significantly with increasing casing diameter. A casing of between about 4 and about 8 inches in internal diameter will typically provide an optimum trade-off between initial cost and capability to transfer heat from the wellbore.

A cement plug 23 is shown at the bottom of the casing, the cement plug being forced down the casing during the cementing operation to force cement out the bottom of the casing.

Catalytic surfaces 20 are provided within the combustion chamber 14 to provide a limited region wherein the oxidation reaction temperature is lowered. Distribution of these catalytic surfaces provide for distribution of heat release within the combustion chamber. The catalytic surfaces are sized to accomplish a nearly even temperature distribution along the casing. A nearly even temperature profile within the casing results in more uniform heat distribution within the formation to be heated. A nearly uniform heat distribution within the formation will result in more efficient utilization of heat in a conductive heating hydrocarbon recovery process. A more even temperature profile will also result in the lower maximum temperatures for the same heat release. Because the materials of construction of the burner and well system dictate the maximum temperatures, even temperature profiles will increase the heat release possible for the same materials of construction.

As the combustion products rise in the wellbore above the formation being heated, heat is exchanged between the combustion air and the fuel gas traveling down the flow conduits and the rising combustion products. This heat exchange not only conserves energy, but permits the desirable flameless combustion of the present invention. The fuel gas and the combustion air are preheated as they travel down the respective flow conduits sufficiently that the mixture of the two streams at the ultimate mixing point is at a temperature above the catalyzed autoignition temperature of the mixture, but below the noncatalyzed autoignition temperature. Combustion on the catalytic surface and flameless combustion within boundary layers adjacent to effective catalyst surfaces results, avoiding a flame as a radiant heat source. Heat is therefore transferred from the wellbore in an essentially uniform fashion.

It is important in the operation of a combustor of the present invention that heat be removed from the combustion chamber along the length of the combustion chamber. In the application of the present invention to a wellbore heat injector, heat is transferred to the formation around the wellbore. The heater of the present is invention could also be used in other applications, such as steam generation and chemical industry process heaters and reactors.

Fuel gas and combustion air transported to the bottom of the wellbore through a mixed fuel and oxidant supply which is shown as an annular volume surrounding the combustion product conduit. The mixed fuel and air react within the wellbore volume adjacent to the catalytic surfaces 14 forming combustion products. The combustion products travel up the wellbore and out an exhaust vent (not shown) at the wellhead through the combustion product conduit 10. From the exhaust vent, the combustion products may be routed to atmosphere through an exhaust stack (not shown). Alternatively, the combustion gases may be treated to remove pollutants, although nitrous oxides would not be present and would not therefore need to be removed. Additional energy recovery from the combustion products by an expander turbine or heat exchanger may also be desirable.

Preheating of the fuel gases to obtain flameless combustion without a catalyst would result in significant generation of carbon unless a carbon formation suppressant is included in the fuel gas stream. The need to provide such a carbon formation suppressant is therefore avoided by operating the heater at a temperature that is less than the carbon formation temperature. This is another significant advantage of the present invention because the carbon suppressant increases the volume of gases to be passed through the heater and therefore increases the size of conduits required.

Cold start-up of a well heater of the present invention may utilize combustion with a flame. Initial ignition may be accomplished by injecting pyrophoric material, an electrical igniter, a spark igniter, temporally lowering an igniter into the wellbore, or an electrical resistance heater. The burner is preferably rapidly brought to a temperature at which a flameless combustion is sustained to minimize the time period at which a flame exists within the wellbore. The rate of heating up the burner will typically be limited by the thermal gradients the burner can tolerate.

The combustion mixture conduit can be utilized as a resistance heater to bring the combustor up to an operating temperature. To utilize this conduit as a resistance heater, an electrical lead 15 can be connected with a clamp 16 or other connection to the combustion mixture conduit 10 near the wellhead below an electrically insulating coupling to supply electrical energy. Electrical ground can be provided near the bottom of the borehole with one or more electrically conducting centralizers 17 around the combustion mixture conduit 10. Centralizers on the combustion mixture conduit above the electrically grounding centralizers are electrically insulating centralizers. Sufficient heat is preferably applied to result in the combustion mixture being, at the location of the initial catalyst surface, at a temperature that is above the catalyzed autoignition temperature but below the noncatalyzed auto ignition temperature.

Thickness of the combustion mixture conduit can be varied to result in release of heat at preselected segments of the length of the fuel conduit. For example, in a well heat injector application, it may be desirable to electrically heat the lowermost portion of the wellbore in order to ignite the mixed gas stream at the highest concentration of fuel, and to burn the fuel before exhaust gasses are passed back up through the wellbore. Thin section 21 is shown in the combustion mixture conduit to provide a surface of elevated temperature for start-up of the combustor.

Oxidation reaction temperature of the fuel gas-oxidant mixture is lowered by provision of a noble metal surface, or another effective catalyst surface. Catalytic surface is preferably provided on either the inside, outside, or both inside and outside surface of the combustion products conduit 10. Alternatively, a surface, or a tubular or other noble metal containing surface, could be separately placed within the combustion chamber. Other noble metal coated surfaces could be provided, for example, in the combustion product annulus outside of the combustion gas conduit. This additional catalyst surface could ensure that complete combustion occurred within the wellbore, where generation of heat is desired.

Start-up of the flameless combustor of the present invention can be further enhanced by provision of supplemental oxidants a during the start-up phase, or by use of a fuel that has a lower catalyzed autoignition temperature such as hydrogen. Preferred supplemental oxidants include supplemental oxygen and nitrous oxide. Hydrogen could be provided along with a natural gas stream, and could be provided as shift gas, with carbon monoxide present and carbon dioxide present.

Start-up oxidants and/or fuels are preferably only used until the combustor has been heated to a temperature sufficient to enable operation with methane (natural gas) as fuel and air as the oxidant (i.e., the combustor has heated to a temperature above the catalyzed autoignition temperature of methane in air).

U.S. Pat. No. 5,255,742 disclosed using an electrical resistance nichrome heater to generate heat for start-up of the flameless combustor. Such an electrical heater may be used in the practice of the present invention.

Noble metals such as palladium or platinum, or semi-precious metal, base metal or transition metal can be coated, preferably by electroplating, onto a surface within the combustion chamber to enhance oxidation of the fuel at lower temperatures. The metal could then be oxidized as necessary to provide a catalytically effective surface. Such catalytic surface has been found to be extremely effective in promoting oxidation of methane in air at temperatures as low as 500° F. This reaction rapidly occurs on the catalytic surface and in the adjacent boundary layer. An advantage of having a significant catalytic surface within the combustion chamber is that the temperature range within which the flameless combustor can operate can be significantly increased.

EXAMPLES

A thermal reactor was used to establish temperatures at which oxidation reactions would occur with various combinations of fuels, oxidants and catalyst surfaces. The reactor was a one inch stainless steel pipe wrapped with an electrical resistance heating coil, and covered with insulation. A thermocouple for temperature control was placed underneath the insulation adjacent to the outer surface of the pipe. Thermocouples were also provided inside the pipe at the inlet, at the middle, and at the outlet. Test ribbons of noble metals or stainless steel strips with noble metal coatings were hung in the pipe to test catalytic activity. Air preheated to a temperature somewhat below the desired temperature of the test was injected into the electrically heated test section of the pipe. Electrical power to the electrical resistance heater was varied until the desired temperature in the test section was obtained and a steady state, as measured by the thermocouples mounted inside the pipe, was achieved. Fuel was then injected through a mixing tee into the stream of preheated air and allowed to flow into the electrically heated test section. Four platinum ribbons one eighth of an inch wide and about sixteen inches long or a stainless steal strip three eighths of an inch wide and about one sixteenth of an inch thick and about sixteen inches long coated on both sides with either platinum or palladium were suspended within the pipe to test catalytic activity. When the test section contained a catalyst coated strep or ribbon of noble metal and was at or above the catalyzed autoignition temperature, the addition of fuel caused a temperature increase at the inside middle and outlet thermocouples. Below the catalyzed autoignition temperature, such a temperature was not observed. When no catalytic coated strips or noble metal ribbons were present, the test section had to be heated to the autoignition temperature of the fuel before a temperature increase was observed. The non-catalyzed and catalyzed autoignition temperatures as measured are summarized in the TABLE, with the measured non-catalyzed or catalyzed autoignition temperature referred to as the measured autoignition temperature.

TABLE

| FUEL | MEASURED AUTO-IGNITION TEMP. °F. | AIR FLOW RATE CC/MIN | FUEL CONC. % OF AIR VOL. % | ACCEL. % OF AIR VOL % | CATA-LYST |
|---|---|---|---|---|---|
| NAT. GAS | 1450 | 380 | 10.5 | | |
| NAT. GAS | 1350 | 380 | 2.6 | $N_2O$/21 | |
| NAT. GAS | 1251 | 380 | 2.6 | $O_2$/40 | |
| DI-METHYL ETHER | 950 | 380 | 2.6 | | |
| DI-METHYL ETHER | 601 | 380 | 2.6 | $N_2O$/21 | |
| $H_2$ | 1218 | 380 | 13 | | |
| $H_2$ | 120 | 380 | 13 | | Pt |
| 66.6% $H_2$ 33.3% CO | 1249 | 380 | 13 | | |
| 66.6% $H_2$ 33.3% CO | 416 | 380 | 13 | | Pt |
| 66.6% $H_2$ 33.3% CO | 411 | 380 | 13 | $N_2O$/44.7 | Pt |
| 66.6% $H_2$ 33.3% CO | 300 | 0 | 13 | 380 CC/MIN 100% $N_2O$ | Pt |
| Methane | 590 | 380 | 13 | — | Pd |
| $H_2$ | 300 | 380 | 13 | — | Pd |
| 66.6% $H_2$ 33.3% CO | 310 | 380 | 13 | — | Pd |

From the TABLE it can be seen that addition of $N_2O$ to the fuel stream greatly reduces the measured autoignition temperature of the mixtures. Further, inclusion of hydrogen as a fuel and presence of the catalytic surface also significantly reduces the dynamic auto-ignition temperatures.

A ten-foot long test combustor was used to test the results of the one inch reactor in a distributed combustor application. A one-inch od. fuel gas line was provided within a two-inch id. combustion line. The fuel injection line provided a conduit for 10 fuel to a fuel injection port located near an inlet end of the combustion line. The two inch id. combustion line was placed within an insulated pipe, and thermocouple were placed along the fuel supply line. Two different combustion lines were utilized. One combustion line was fabricated from a strip of "HAYNES 120" alloy. The strip was electro brush plated on one side with palladium to an average thickness of $10^4$ inches. The strip was then break formed, swedged and welded in to a ten foot long pipe with the palladium coating on the inside surface. The other combustion line was a standard three inch pipe of "HAYNES 120" alloy. A "MAXON" burner was used to supply combustion gases to the 10 foot long combustion pipe, and varying amounts of air and/or other additives are mixed with the exhaust from the "MAXON" burner in a mixing section between the burner and the combustion line. To maintain a uniform temperature within the combustion line, three electric heaters, each with its own controller, were placed outside and along the length of the combustion line.

Figure 2:
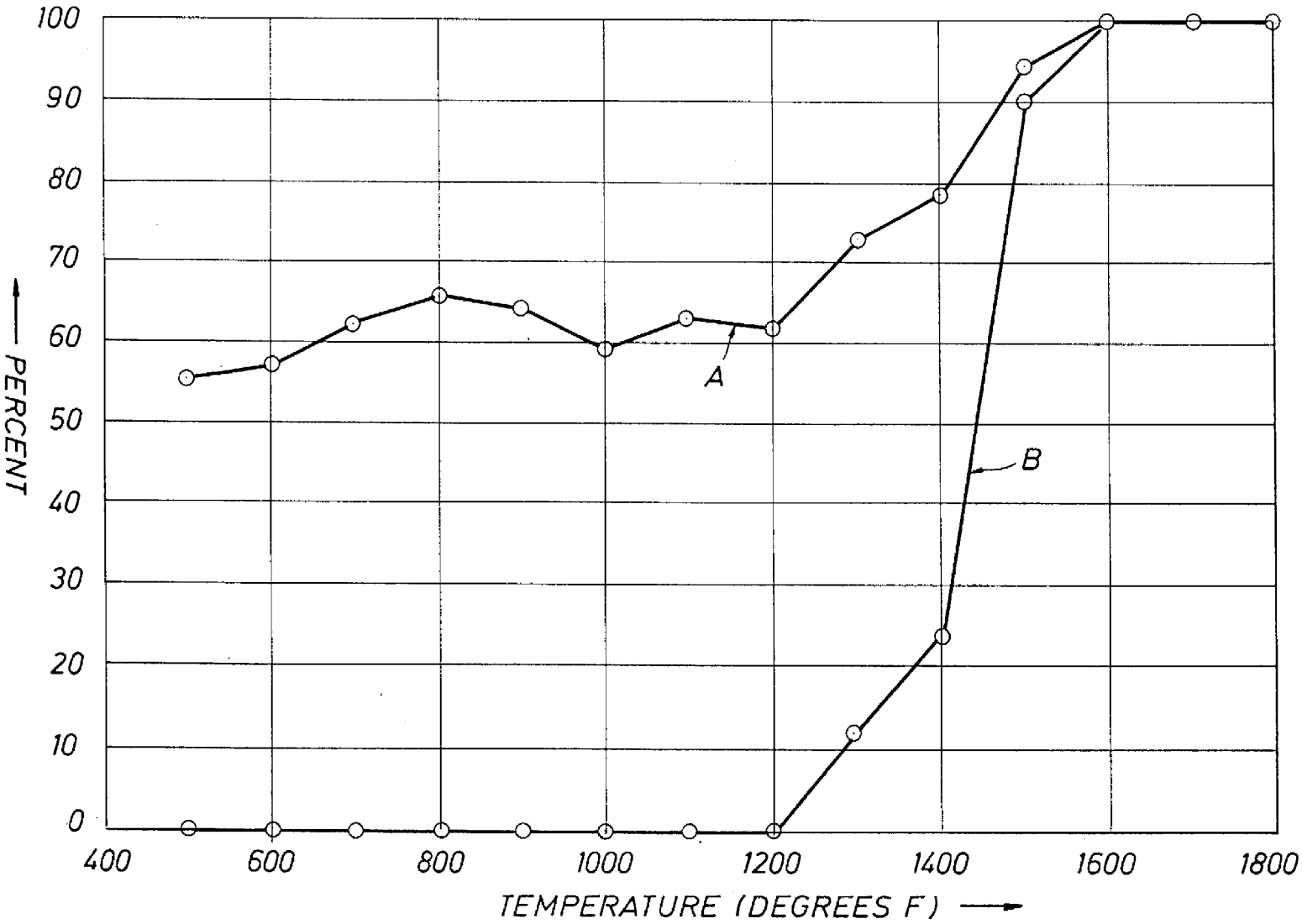
FIG. 2 is a plot of methane consumption vs. temperature in a test apparatus demonstrating the present invention.

A series of tests were run, one with the palladium coated combustion line and one with the combustion line that was not palladium coated. Fuel gas was injected through the fuel gas injection port at a rate of 0.374 SCFM, and 220 SCEM of air was injected, including the burner air and the secondary air. Enough fuel gas was provided to the burner to provide a target temperature at the inlet of the combustion line. Percentage of the injected methane that was burned is shown as a function of the combustion line inlet temperature in FIG. 2 for catalyzed configuration (line A) and noncatalyzed configuration (line B). From FIG. 2 it can be seen that at the lowest temperatures at which the apparatus can be operated is about 500° F., 55% of the methane was oxidized with the palladium coated combustion line. The lowest temperature of operation might be somewhat below 500° F. but the equipment available was not capable of operation at lower temperature. When the combustion line without the palladium coating was used, some oxidation of methane occurred at 1300° F., and oxidation of methane occurs rapidly at temperatures of about 1500° F. At temperatures of 1600° F. and above, the presence of the palladium surface has no effect because oxidation of methane is rapid and complete either with or without the palladium surface.

The temperature independence of the methane oxidized below 1300° F. tends to verify that the methane within the boundary layer at the surface of the palladium surface oxidizes rapidly, and that transportation of methane to this boundary layer, and not kinetics, dictates the extent to which methane is oxidized. At temperatures of about 1300° F. and greater, thermal oxidation becomes prevalent, and a temperature dependence is due to this thermal oxidation.

We claim:

1. A flameless combustor for combustion of a fuel and oxidant mixture, the combustor comprising:

a combustion chamber in communication with an inlet at one end and in communication with a combustion product outlet at the other end;

a mixed fuel and oxidant supply in communication with the inlet;

a preheat section wherein in the preheat section heat can be exchanged between the fuel and oxidant mixture and the combustion products; and a catalyst surface within the combustion chamber wherein the catalyst surface is effective to cause oxidization of an amount of fuel wherein the oxidation of the amount of fuel does not result in a temperature above an uncatalyzed autoignition temperature of the fuel and oxidant mixture.

2. The combustor of claim 1 wherein the catalyst surface is comprises a component selected from the group consisting of noble metals, semi-precious metals, transition metal oxides and mixtures thereof.

3. The combustor of claim 1 wherein the catalytic surface comprises palladium.

4. The combustor of claim 1 wherein the catalytic surface comprises platinum.

5. A flameless combustor for heating a subterranean formation by combustion of a fuel and oxidant mixture to combustion products, the combustor comprising:

a wellbore within the formation to be heated:

a preheat section wherein in the preheat section heat can be exchanged between the fuel and oxidant mixture and the combustion products; and a combustion tubular within the wellbore, the combustion tubular defining a combustion chamber, the combustion chamber in communication with an inlet at one end and in communication with a combustion product outlet at the other end, a mixed fuel and oxidant supply in communication with the inlet, and a catalyst surface within the combustion chamber wherein the catalyst surface is effective to cause oxidization of an amount of fuel wherein the oxidation of the amount of fuel does not result in a temperature above the uncatalyzed autoignition temperature of the fuel and oxidant mixture.

6. The combustor of claim 5 wherein the catalyst surface area is distributed within the combustion chamber to result in an essentially constant temperature within the combustion chamber.

7. The combustor of claim 5 wherein the combustion chamber is defined by a tubular pipe placed within the wellbore.

8. The combustor of claim 5 further comprising a combustion gas outlet wherein the combustion gas outlet is an annular space surrounding the combustion tubular.

9. The combustor of claim 5 further comprising a combustion gas outlet wherein the combustion gas outlet is a tubular within the combustion chamber.

10. The combustor of claim 5 wherein the combustion chamber comprises an annular volume between a tubular and a casing.

11. The combustor of claim 10 wherein the tubular is a conduit for return of combustion products to a wellhead.

12. The combustor of claim 5 wherein the tubular is a conduit containing another portion of the combustion chamber.

13. The combustor of claim 5 wherein the catalytic surface comprises palladium.

14. The combustor of claim 5 wherein the catalytic surface comprises platinum.

* * * * *